US009394144B2

(12) United States Patent
Srb-Gaffron et al.

(10) Patent No.: US 9,394,144 B2
(45) Date of Patent: Jul. 19, 2016

(54) OFFSET PALLET GUIDANCE FOR PASSENGER CONVEYOR

(71) Applicant: OTIS ELEVATOR COMPANY, Farmington, CT (US)

(72) Inventors: Walter Srb-Gaffron, Baden (AT); Alexander Turek, Vienna (AT)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 14/439,424

(22) PCT Filed: Nov. 1, 2012

(86) PCT No.: PCT/US2012/062974

§ 371 (c)(1),
(2) Date: Apr. 29, 2015

(87) PCT Pub. No.: WO2014/084805

PCT Pub. Date: Jun. 5, 2014

(65) Prior Publication Data

US 2015/0307327 A1 Oct. 29, 2015

(51) Int. Cl.
*B66B 21/10* (2006.01)
*B66B 23/14* (2006.01)

(52) U.S. Cl.
CPC ..... *B66B 23/147* (2013.01); *B66B 21/10* (2013.01); *B66B 23/14* (2013.01)

(58) Field of Classification Search
CPC .... B66B 23/14; B66B 23/145; B66B 23/147; B66B 21/10; B66B 21/12; B66B 21/02; B66B 21/025; B66B 221/04
USPC ..... 198/321
See application file for complete search history.

(56) References Cited

U.S. PATENT DOCUMENTS 2,369,840 A * 2/1945 Nalbach ..... A21B 1/48 198/799

(Continued)

FOREIGN PATENT DOCUMENTS

JP 2000007263 A 1/2000
JP 2000177965 A 6/2000

(Continued)

OTHER PUBLICATIONS

Notification of Transmittal of the International Search Report of the International Searching Authority; PCT/US2012/062974; Mailed May 28, 2014; 5 Pages.

(Continued)

*Primary Examiner* — Mark A Deuble
(74) *Attorney, Agent, or Firm* — Cantor Colburn LLP

(57) ABSTRACT

A passenger conveyor includes a plurality of pallets arranged to form a travel surface of the passenger conveyor. A first guide member extends from a first longitudinal end of the travel surface and is located at a first lateral side of the plurality of pallets, and a second guide member extends from the first longitudinal end and is located at a second lateral side of the plurality of pallets. A position of the second guide member is offset in a longitudinal direction along the travel surface relative to the first guide member. The first guide member and the second guide member are pivotably connected to the plurality of pallets to guide movement of the plurality of pallets.

17 Claims, 4 Drawing Sheets

(56) References Cited

U.S. PATENT DOCUMENTS

| | | | | | |
|---|---|---|---|---|---|
| 2,512,356 | A * | 6/1950 | Massiello | A21B 1/48 | 198/798 |
| 2,893,538 | A * | 7/1959 | Buttironi | B65G 35/08 | 198/795 |
| 5,060,779 | A * | 10/1991 | Landaeus | B65G 17/123 | 198/321 |
| 7,537,100 | B2 * | 5/2009 | Mustalahti | B66B 23/147 | 198/321 |

FOREIGN PATENT DOCUMENTS

| | | | |
|---|---|---|---|
| JP | 2001253674 | A | 9/2001 |
| JP | 2002338178 | A | 11/2002 |
| WO | 2011033178 | A1 | 3/2011 |

OTHER PUBLICATIONS

Written Opinion of the International Searching Authority; PCT/US2012/062974; Mailed May 28, 2014; 8 Pages.

* cited by examiner

OFFSET PALLET GUIDANCE FOR PASSENGER CONVEYOR

BACKGROUND OF THE INVENTION

The subject matter disclosed herein relates to passenger conveyors. More specifically, the subject matter disclosed herein relates to guidance systems for passenger conveyors.

A typical passenger conveyor, such as a moving walkway, includes a plurality of interconnected pallets that form the travel surface of the moving walkway. The pallets are connected to a guide member, which may be driven along a path by a machine, for example, an electric motor. The return portion of the walkway, beneath the travel surface, is typically located in a pit below floor level of the structure the walkway is installed in. This pit houses the return portion of the walkway, as well as the drive motor, drive chain, and other components of the walkway system. In order to reduce installation cost and complexity, it is desired to lower the profile of the walkway system to minimize a depth of the pit, or entirely eliminate the pit for moving walkway installation.

BRIEF DESCRIPTION OF THE INVENTION

According to one aspect of the invention, a passenger conveyor includes a plurality of pallets arranged to form a travel surface of the passenger conveyor. A first guide member extends from a first longitudinal end of the travel surface and is located at a first lateral side of the plurality of pallets, and a second guide member extends from the first longitudinal end and is located at a second lateral side of the plurality of pallets. A position of the second guide member is offset in a longitudinal direction along the travel surface relative to the first guide member. The first guide member and the second guide member are pivotably connected to the plurality of pallets to guide movement of the plurality of pallets.

Alternatively in this or other aspects of the invention, the first guide member and the second guide member are a first pallet chain and a second pallet chain.

Alternatively in this or other aspects of the invention, the second pallet chain is offset from the first pallet chain by about a multiple of one or more pallet chain link lengths.

Alternatively in this or other aspects of the invention, the second pallet chain is offset from the first pallet chain by two pallet chain link lengths.

Alternatively in this or other aspects of the invention, each pallet of the plurality of pallets is connectable to the first guide member and the second guide member via at least one pivot linkage member Alternatively in this or other aspects of the invention, the first guide member and the second guide member extend substantially from the first longitudinal end to a second longitudinal end of the travel surface.

Alternatively in this or other aspects of the invention, the passenger conveyor includes a return portion, and a turnaround portion located at the first longitudinal end and/or a second longitudinal end of the travel surface between the travel surface and the return portion. Each pallet of the plurality of pallets is conveyed through the turnaround portion without being inverted.

Alternatively in this or other aspects of the invention, the passenger conveyor includes a sprocket located in the turnaround portion to guide the guide members through the turnaround portion.

Alternatively in this or other aspects of the invention, the sprocket is operably connected to a drive machine to drive the moving walkway.

According to another aspect of the invention, a method for operating a passenger conveyor includes pivotably connecting at least one pallet of a plurality of pallets of the passenger conveyor to a first guide member extending from a first longitudinal end of the passenger conveyor and located at a first lateral side of the plurality of pallets. The at least one pallet is pivotably connected to a second guide member extending from the first longitudinal end and located at a second lateral side of the plurality of pallets. A position of the second guide member is offset in a longitudinal direction along the moving walkway relative to the first guide member. The at least one pallet is urged toward a turnaround portion of the passenger conveyor via motion of the first guide member and the second guide member. A longitudinal direction of travel of the at least one pallet is reversed at the turnaround portion without inverting the at least one pallet via the pivotable connection between the at least one pallet and the first guide member and second guide member.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
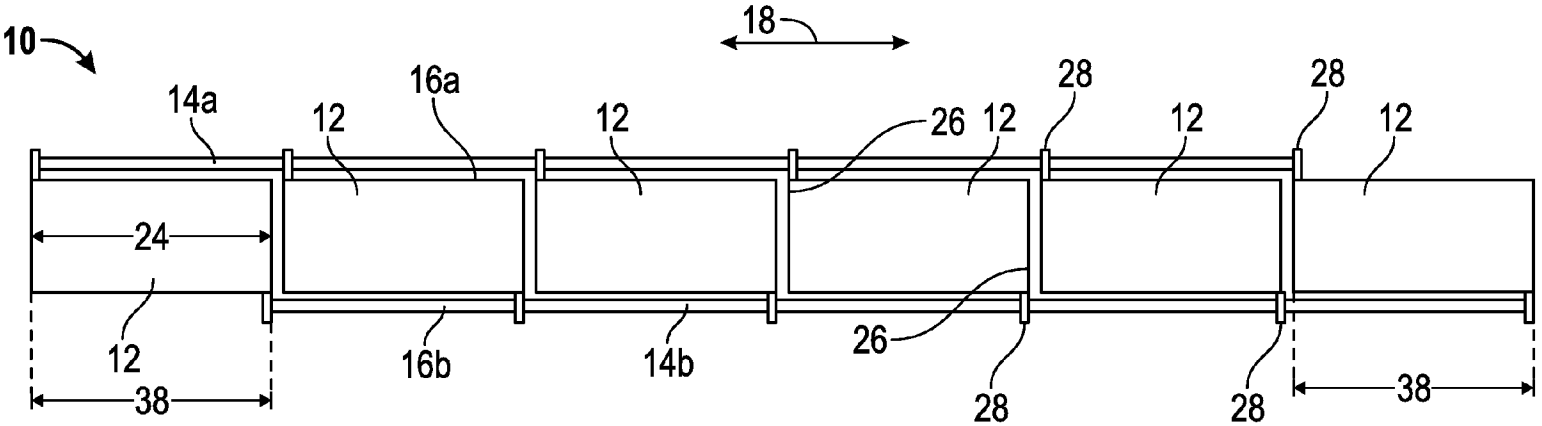
FIG. 1 is a schematic illustration of an embodiment of a moving walkway.
Figure 2:
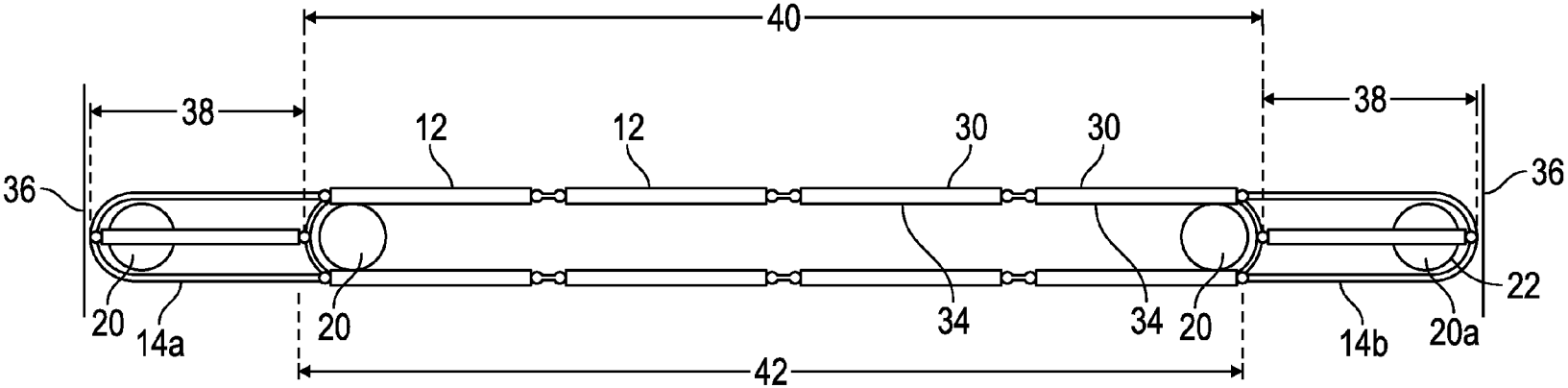
FIG. 2 is a side view of an embodiment of a moving walkway.

Shown in FIG. 1 is a schematic view of an embodiment of a passenger conveyor, in this embodiment a moving walkway 10. While described in embodiments of a moving walkway, it is to be appreciated that the disclosure herein is applicable to other types of passenger conveyors such as escalators. The embodiment of FIG. 1 includes a plurality of pallets 12, with each pallet 12 connected to two guide members 14. The guide members 14 are commonly pallet chains, but other guide members 14, for example, belts, may be utilized. The guide members 14 are located at each lateral side 16 of the pallets 12. The guide members 14 extend in a longitudinal direction 18 along the moving walkway 10 and guide the pallets 12 along the moving walkway 10. In some embodiments, as shown in FIG. 2, the guide members 14 are continuous guide members 14 that are looped around two or more sprockets 20. One of the sprockets 20 may be a drive sprocket **20*a*, which drives the guide members 14 via a drive machine 22**.

Referring again to FIG. 1, the guide members 14 include a first guide member **14*a* located at a first lateral side 16*a* of the moving walkway 10, and a second guide member 14*b* located at a second lateral side 16*b* of the moving walkway 10. The guide members 14***a* and 14*b* are offset from one another in the longitudinal direction 18 by a selected fractional length of guide members 14. For example, in an embodiment where the guide members 14 are pallet chains, the guide members 14*a* and 14*b* are offset from one another by a multiple of pallet chain link lengths 70 (best shown in FIG. 4), such as 1, 2 or 4 link lengths.

Referring again to FIG. 2, a side view of the moving walkway 10 is shown. Each pallet 12 has a travel surface 30, generally facing upward in the figure, on which passengers or other items conveyed by the moving walkway 10, such as packages or vehicles, are positioned. The pallets 12 further include bottom surfaces 34 substantially opposite the travel surfaces 30. At each longitudinal end 36 of the moving walkway 10, is a turnaround portion 38, where the moving walkway 10 reverses direction between a travel portion 40 and a return portion 42 beneath the travel portion 40. In the turnaround portion 38, as the guide members 14*a* and 14*b* loop around the sprockets 20, the pallets 12 travel through the turnaround portion 38 and reverse direction without inversion of the pallets 12.

Figure 3:
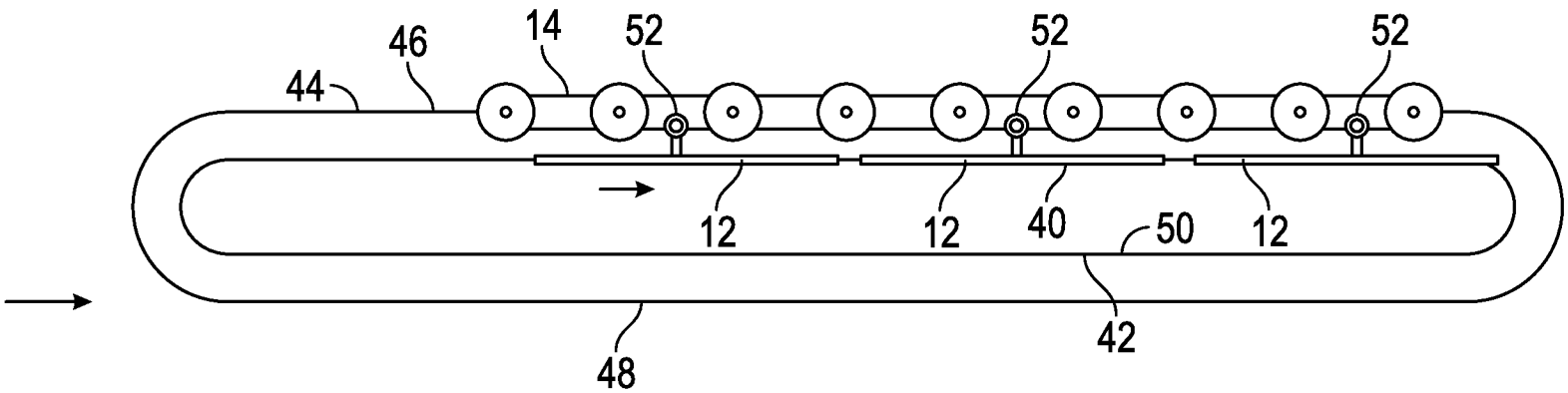
FIG. 3 is a schematic view of another embodiment of a moving walkway.

Referring now to FIG. 3, the reversal of the pallets 12 without inversion is enhanced by integration with a chain and pallet track configuration referred to as track separation. The guide member 14 has a chain track 44 or path including a chain travel portion 46 and a chain return portion 48, and the pallets 12 trace a pallet track 50 including the travel portion 40 and the return portion 42. In moving walkways having track separation, the pallet track 50 does not follow the chain track 44, due to a pivot 52 at the guide member 14.

Figure 4:
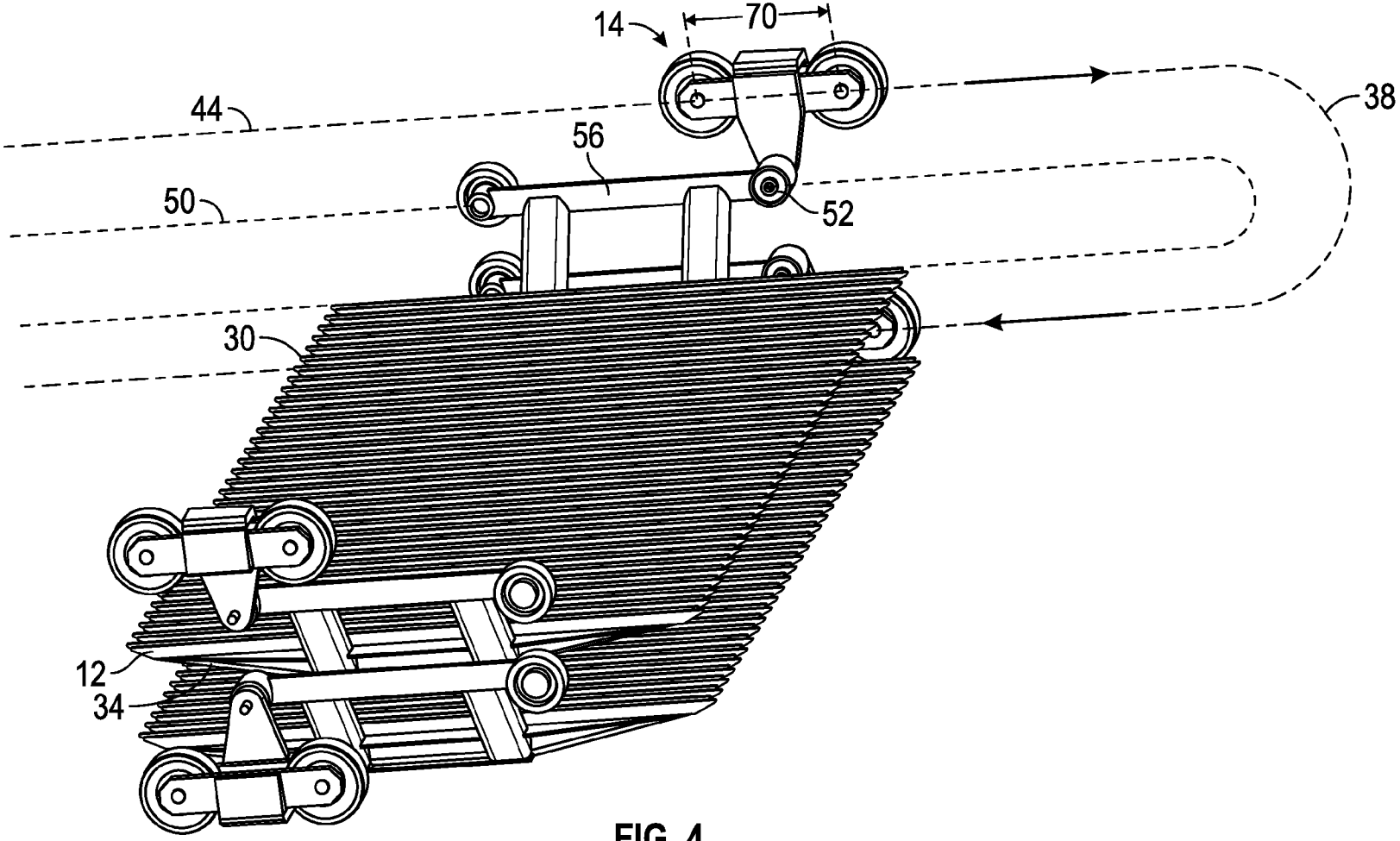
FIG. 4 illustrates a pivotable connection between a guide member and pallet of a moving walkway.

As shown in FIG. 4, when the pallets 12 reach the turnaround portion 38, the pallets 12 rotate about the pivot 52 so that the travel surfaces 30 remain facing generally upward. The travel surfaces 30 remain generally facing upward and the bottom surfaces 34 remain facing generally downward. In some embodiments, the pivot 52 includes one or more linkage members 56, as shown. It is to be appreciated, however, that other pivot 52 configurations are contemplated within the present scope. For example, a pin and bracket arrangement may be used, where the pin extending from the pallet 12 to be pivotable secured to a bracket traveling with the guide member. Alternatively, the positions of the pin and the bracket may be reversed.

Figure 5:
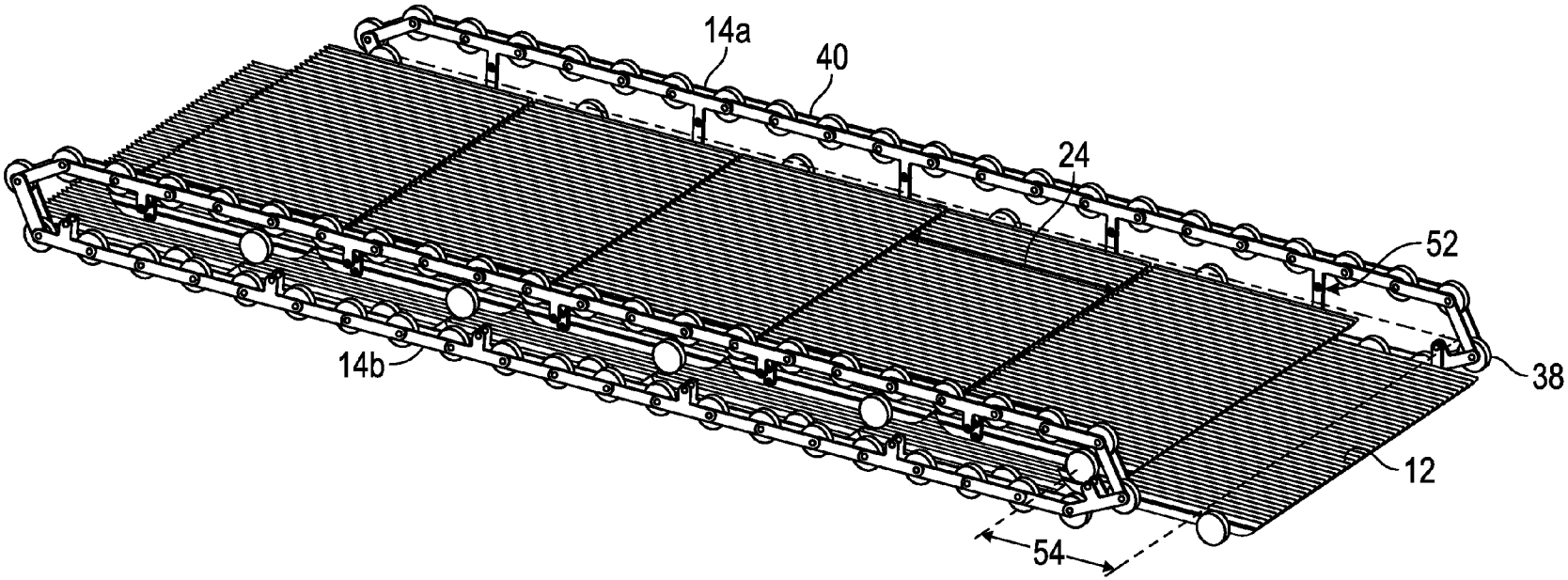
FIG. 5 illustrates another embodiment of a moving walkway.

Referring to FIG. 5, an embodiment is shown including both an offset 54 of the guide members 14*a*, 14*b* and the track separation pivot 52. Reversing direction of the pallets 12 without flipping or inverting the pallets 12 in the turnaround portion 38 gives the moving walkway 10 a substantially lower profile, as a distance between the travel portion 40 and the return portion 42 is not defined by the pallet length 24, as is the case when the pallets 12 are inverted at the turnaround portion 38. A combination of the offset of guide members 14*a* and 14*b*, the track separation and attaching the pallets 12 to the guide members 14*a* and 14*b* via pivots 52 allows for disclosed smooth and stable direction reversal of the pallets 12 without inversion and with a low profile.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A passenger conveyor comprising:

a plurality of pallets arranged to form a travel surface of the passenger conveyor;

a first guide member extending from a first longitudinal end of the travel surface and disposed at a first lateral side of the plurality of pallets, the first guide member supported of two or more pallets of the plurality of pallets; and a second guide member extending from the first longitudinal end and disposed at a second lateral side of the plurality of pallets, a position of the second guide member offset in a longitudinal direction along the travel surface relative to the first guide member, the second guide member supportive of two or more pallets of the plurality of pallets, the first guide member and the second guide member operably connected to two or more sprockets;

wherein the first guide member and the second guide member are pivotably connected to the plurality of pallets to guide movement of the plurality of pallets;

the first guide member and the second guide member defining a guide track, a travel path of the plurality of pallets defining a pallet track;

wherein a travel portion of the pallet track is radially offset from a travel portion of the guide track relative to an axis defined by centers of the two or more sprockets.

2. The passenger conveyor of claim 1, wherein the first guide member and the second guide member are a first pallet chain and a second pallet chain.

3. The passenger conveyor of claim 2, wherein the second pallet chain is offset from the first pallet chain by about a multiple of one or more pallet chain link lengths.

4. The passenger conveyor of claim 3, wherein the second pallet chain is offset from the first pallet chain by two pallet chain link lengths.

5. The passenger conveyor of claim 1, wherein each pallet of the plurality of pallets is connectable to the first guide member and the second guide member via at least one pivot linkage member.

6. The passenger conveyor of claim 1, wherein the first guide member and the second guide member extend substantially from the first longitudinal end to a second longitudinal end of the travel surface.

7. The passenger conveyor of claim 1, further including a track to guide the guide members, a track to guide the pallets, and wherein the guide member track and the pallet track are separated.

8. The passenger conveyor of claim 1, further comprising:

a return portion; and a turnaround portion disposed at the first longitudinal end and/or a second longitudinal end of the travel surface between the travel surface and the return portion;

wherein each pallet of the plurality of pallets is conveyed through the turnaround portion without being inverted.

9. The passenger conveyor of claim 8, further comprising a sprocket disposed in the turnaround portion to guide the guide members through the turnaround portion.

10. The passenger conveyor of claim 9 wherein the sprocket is operably connected to a drive machine to drive the passenger conveyor.

11. A method for operating a passenger conveyor comprising:

pivotably connecting at least one pallet of a plurality of pallets of the passenger conveyor to a first guide member extending from a first longitudinal end of the passenger conveyor and disposed at a first lateral side of the plurality of pallets, the first guide member supportive of two or more pallets of the plurality of pallets;

pivotably connecting the at least one pallet to a second guide member extending from the first longitudinal end and disposed at a second lateral side of the plurality of pallets, a position of the second guide member offset in a longitudinal direction along the passenger conveyor relative to the first guide member, the second guide member supportive of two or more pallets of the plurality of pallets, the first guide member and the second ,guide member operably connected to two or more sprockets;

the first guide member and the second guide member defining a guide track, a travel path of the plurality of pallets defining a pallet track;

wherein a travel portion of the pallet track is radially offset from a travel portion of the guide track relative to an axis defined by centers of the two or more sprockets:

urging the at least one pallet toward a turnaround portion of the passenger conveyor via motion of the first guide member and the second guide member;

reversing a longitudinal direction of travel of the at least one pallet at the turnaround portion without inverting the at least one pallet via the pivotable connection between the at least one pallet and the first guide member and second guide member.

12. The method of claim 11, further comprising guiding the first guide member over a sprocket disposed in the turnaround portion to guide the guide member through the turnaround portion.

13. The method of claim 12, further comprising driving movement of the passenger conveyor via a drive machine operably connected to the sprocket.

14. The method of claim 11, wherein the first guide member and the second guide member are a first pallet chain and a second pallet chain.

15. The method of claim 14, wherein the second pallet chain is offset from the first pallet chain by about a multiple of one or more pallet chain link lengths.

16. The method of claim 15, wherein the second pallet chain is offset from the first pallet chain by two pallet chain link lengths.

17. The method of claim 11, further including driving the guide members along a guide member track, driving the pallets along a pallet track, and wherein the guide member track and pallet track are separated.

* * * * *